US006638059B1

(12) United States Patent
Mougey

(10) Patent No.: US 6,638,059 B1
(45) Date of Patent: Oct. 28, 2003

(54) BURNER-TYPE APPARATUS AND FUEL COMBUSTION METHOD

(75) Inventor: Gérard Mougey, Honfleur (FR)

(73) Assignee: Total Raffinage Distribution S.A., Puteaux (FR)

( * ) Notice: Subject to any disclaimer, the term of this patent is extended or adjusted under 35 U.S.C. 154(b) by 0 days.

(21) Appl. No.: 09/869,516

(22) PCT Filed: Dec. 28, 1999

(86) PCT No.: PCT/FR99/03300

§ 371 (c)(1),
(2), (4) Date: Sep. 27, 2001

(87) PCT Pub. No.: WO00/40902

PCT Pub. Date: Jul. 13, 2000

(30) Foreign Application Priority Data

Dec. 30, 1998 (FR) ..... 98 16622

(51) Int. Cl.[7] ..... F23D 14/04; F23D 14/64
(52) U.S. Cl. ..... 431/202; 431/354
(58) Field of Search ..... 431/202, 354, 431/355, 5; 239/419.5, 589, 592; 48/180.1, 189.3, 3 R; 417/180, 151, 179, 155–157; 110/127, 150, 157

(56) References Cited

U.S. PATENT DOCUMENTS 315,187 A * 4/1885 Thomas ..... 417/179
1,181,125 A * 5/1916 Erlwine ..... 417/179
1,264,116 A * 4/1918 Moss ..... 417/179
1,421,840 A * 7/1922 Schmidt ..... 417/184
1,449,504 A * 3/1923 Ehrhart ..... 417/54
2,072,599 A * 3/1937 Lemaitre
2,111,266 A * 3/1938 Hopkins ..... 417/179
2,164,263 A * 6/1939 Wall ..... 417/179
3,101,773 A * 8/1963 Blaha
3,659,962 A * 5/1972 Zink et al. ..... 417/179
4,445,464 A * 5/1984 Gerstmann et al. ..... 122/18.4
4,784,810 A * 11/1988 Jorzyk et al. ..... 261/17

FOREIGN PATENT DOCUMENTS

EP 99828 * 2/1984
SU 1236253 * 6/1986 ..... 431/354

* cited by examiner

*Primary Examiner*—Carl D. Price
(74) *Attorney, Agent, or Firm*—Sughrue Mion, PLLC

(57) ABSTRACT

The invention concerns a burner-type apparatus designed to facilitate fuel gas combustion in the atmosphere, comprising a combustion zone (1) supplied with at least a fuel gas through at least a tube (2) for burning gas intake. The invention is characterized in that the tube (2) end is enclosed with a plurality of elements (3) arranged around the latter each consisting of a venturi and motive fluid supply, and designed to increase the quantity of air in the combustion zone.

17 Claims, 2 Drawing Sheets

BURNER-TYPE APPARATUS AND FUEL COMBUSTION METHOD

The invention concerns equipment and a process permitting better combustion to be obtained of a gas specifically containing hydrocarbons. This equipment and process can be used, for example, in flares of a oil refinery or in oil and gas production fields, to burn the residual gases or the gaseous emissions without emissions of unburned hydrocarbons.

STATUS OF THE TECHNOLOGY

Oil processing in a refinery entails the production of residual gases and gaseous emissions, where the elimination by combustion in gas burning systems, called either "flares" or "gas flares" in the profession, can be the source of poisonous and malodorous emissions, smoke or noise, harmful to the environment.

These nuisances and notably those contributed by the incomplete combustion of gas, for example, rich in hydrogen sulfide ($H_2S$), generally appear, when the quantity of air necessary for perfect combustion is insufficient, that is to say when the ratio between the flow of gas to be burned and the air flow necessary for combustion is less than the stochiometric ratio, and when the three conditions necessary for optimal combustion, called "the three T's," namely the Temperature of the flame, the Time of air/gas mixing before burning and the Turbulence applied to this mixture, are insufficiently met.

It is generally due to the fact that the excess of gas to burn has a relatively low pressure and a high flow which can reach up to 10,000,000 $Sm^3$/day, arising, for example from an operational failure of an oil refining unit or on an oil or gas production site. Since the pressure of the gas to burn remains low overall, this does not permit a sufficiently active aeration of the flame by the gas pressure at the outlet of the feed tube of the flare. The fuel-comburant mixture in the combustion zone becoming deficient in the air content necessary for a perfect combustion therefore requiring an external contribution of comburant by any means available in the technology to improve the gas combustion.

Up till now, injection devices have been relied upon, fed, for example, by steam traversing the injectors, or other motive fluids such as air or gas, that inducts air and the necessary turbulence for the combustion. However, these devices have the low performances, which requires using significant quantities of fluids to compensate for their lack of efficiency.

It turns out, in a refinery, for example in the case of using steam as a motive fluid, a heavy consumption has the effects of:

- a significant noise emission, due to the passage of the steam in tubes and injectors;
- a cooling of the flame, that does not permit ensuring the correct conditions for gas combustion, for example the acidic gases such as $H_2S$, where a temperature of 700° C. required for its complete oxidation is not attained, under these conditions, thus producing some toxic and malodorous emissions;
- an energy balance of the site may show a deficit, since it depends on the production of steam.

Generally there is no steam available on the oil and gas production fields, and the pressure of the gas to be burned is too low to be used as source of sufficient mixing power for the fuel/comburant. Therefore, the combustion of waste, that is gases rich in hydrocarbons and sometimes liquid hydrocarbons, called condensates, is incomplete and usually accompanied by thick black smoke.

GB 1 323 674 describes an equipment of the flare type, supplied with a combustion gas by at least one input tube of the gas to be burned. The end of the tube is surrounded with a multiplicity of devices arranged around it and each containing a venturi and a motive fluid feed, FR 573 059 describes a blowing equipment in which a fluid under pressure is used to entrain another fluid and impart speed to it. A multiplicity of motive fluid feed tubes are arranged in an essentially annular fashion around the axis of at least one venturi, so as to suck in the second fluid before injection into a combustion zone.

U.S. Pat. Nos. 1,443,315 A and 3,554,681 also describe devices in which injection devices of a first gas, arranged in crown at the input of a venturi, entrains a second gas into it.

The builders of flares have also considered a solution that consists, for example, of bringing air into the combustion zone by means of groups of high power fans, arranged for example under the flare, and to stagger the gas distribution with the help of automatic valves controlled by complex instrumentation. This solution proves to be applicable only with difficulty, since there are high investment costs and operation costs, and besides, it is rendered somewhat unreliable by the installation of fans under the flame in a hot and corrosive atmosphere, and also raises safety problems due to the possible falling of easily inflammable liquid hydrocarbons on the hot fans.

The Applicant therefore did a search with a view to finding solutions that are, both satisfactory on the technical level, simple, reliable and where the corresponding investment cost is low, either in a refinery and on a production site, to obtain smokeless combustion of a gas which can contain some liquid hydrocarbons.

SUMMARY STATEMENT OF THE INVENTION

The Applicant has thus succeeded in improving a gas flare type of equipment, so as to facilitate the combustion of fuel gases in the atmosphere, containing a combustion zone supplied with at least one fuel gas for at least one input tube of the gas to be burned, the end of the said tube being surrounded with a multiplicity of devices arranged around this end and each composed of a venturi and a motive fluid feed, this equipment being characterized:

- in that each of devices includes a multiplicity of tubes arranged in an essentially annular fashion around axis AA of the venturi;
- and in that the set of tubes of each device, which injects the motive fluid into the venturi, diverge from one another forming an angle $\alpha$ with the axis AA of the venturi, greater than 3° and preferably essentially equal to the angle that forms the divergent flare of the said venturi with said axis.

This equipment has the major advantage of permitting a smokeless combustion, even when the gas pressure is low and the flow high and it contains some liquid hydrocarbons.

The invention also has as its object the use of the equipment defined above to facilitate the combustion in a combustible gas atmosphere feeding the gas input tube, while tubes of devices for input of the motive fluid are fed by a fluid chosen from the groups constituted by air, air enriched with oxygen, steam or a combustible gas, this use being characterized in that that the pressure of the motive fluid is comprised between 0.5 and $6.10^5$ Pa, preferably, between 1 and $3.10^5$ Pa, and in that each tube transports between 1% and 33% and, preferably, between 5% and 33% of this motive fluid.

This use eliminates resorting to fans as well as the resultant noise from the passage in the injectors of a fluid such as steam.

In addition to a complete, smokeless combustion, the equipment of the invention permits, on the one hand, decreasing the consumption of the motive fluid, for example steam, and, on the other hand increasing the reliability of the facility by the absence of moving parts, such as fans, so as to have a process that is easily implemented, and involves installation and operational costs that are relatively low.

Other advantages and features of the equipment and the process according to its invention come from following the present description, which will refer to FIGS. 1 to 3 of the attached drawings, that do not have a restrictive character.

SUMMARY DESCRIPTION OF FIGURES

DETAILED STATEMENT OF THE INVENTION

Equipment According to the Invention

Figure 1:
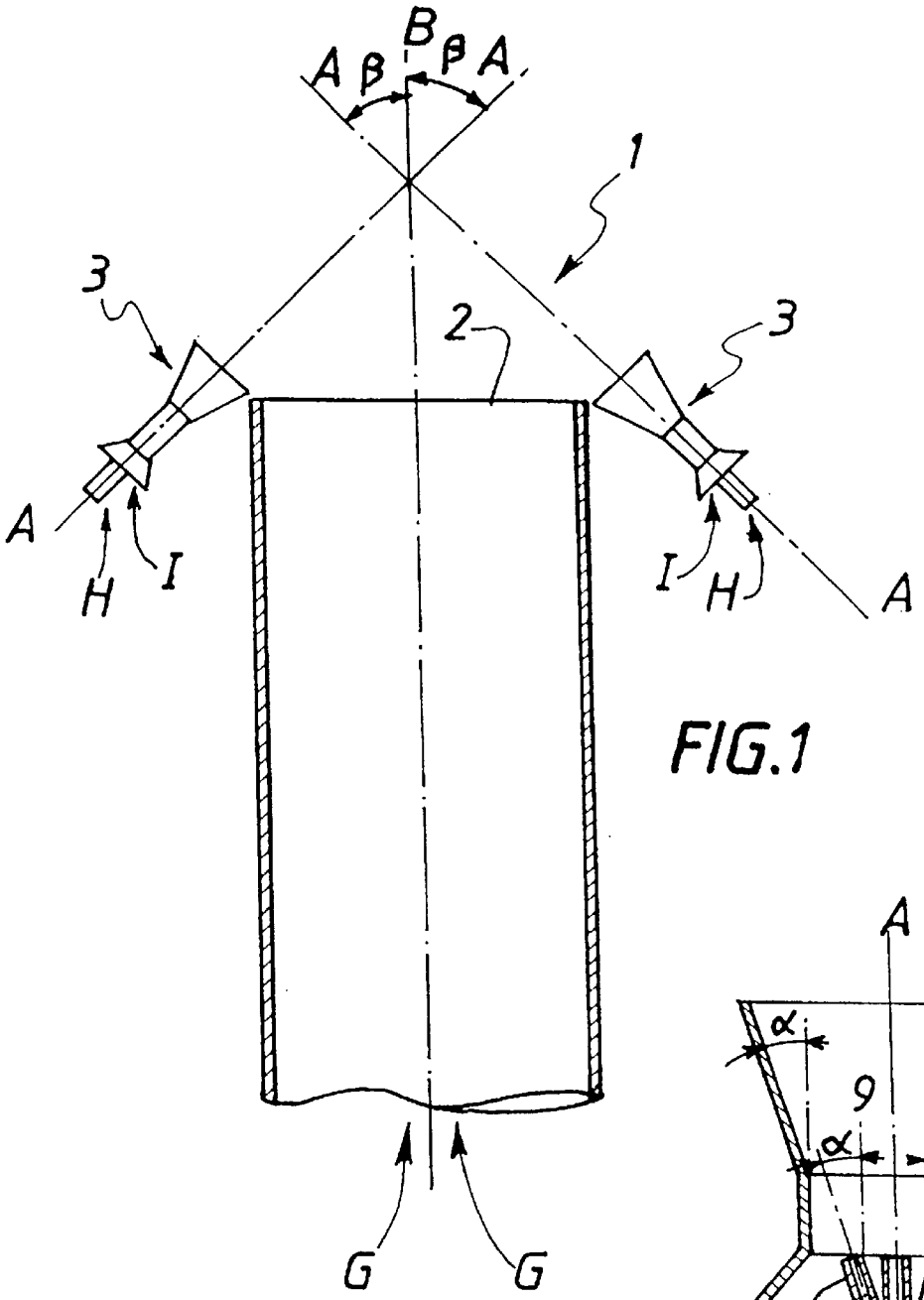
FIG. 1 represents an equipment schematically according to the invention, in view from the side and in cross section.

The combustion equipment according to the invention is represented in FIG. 1 such that the upper part can be installed on the upper part of a gas flare.

It includes a combustion zone 1, with an input of combustion gas constituted by a tube 2 of the gas to be burned. Around the end of this input tube 2 of the gas to be burned is arranged essentially in annular fashion a multiplicity of intake devices 3 of a motive fluid under pressure.

As can be seen on FIG. 1, the devices 3 are inclined toward the combustion zone, that is to say towards the axis BB of tube 2, their axes of symmetry AA forming an angle β with the BB symmetry axis of input tube 2 of the gases to be burned comprised between 1° and 70°, and preferably between 5° and 60°.

Figure 2:
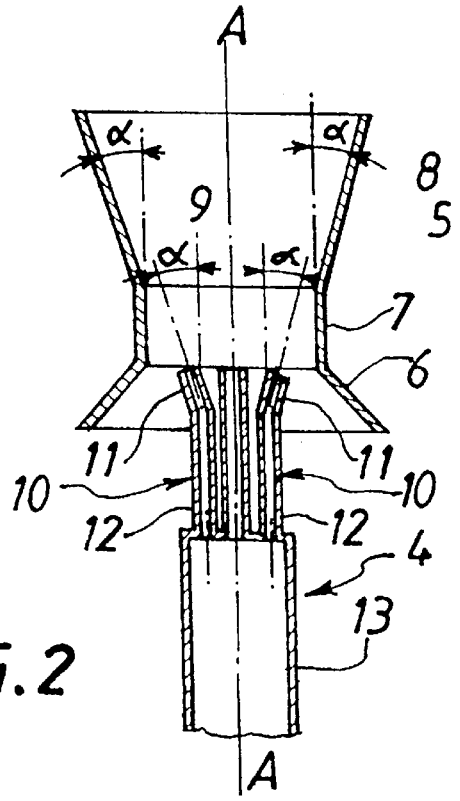
FIG. 2 is a detailed schematic view of one of the devices from FIG. 1, in view from the side and in cross section.

FIG. 2 illustrates one form of realization of a device 3. The latter is composed of a motive fluid input 4, on the outlet of which is placed a body forming a venturi 5, itself constituted of a lower tapered part 6, generally called "convergent," and that is extended by a cylindrical part 7 called "neck," this latter part being extended by an upper tapered part 8 called "divergent."

The motive fluid feed 4 of each of the venturis 5, starting from feed tube 13, comprises a central tube 9, that is usually annular in cross section and essentially arranged coaxially to axis AA of the venturi 5. The central tube 9 extends from the outside, while passing into the convergent 6, until a point situated in the venturi 5, in general at the level of the junction of the convergent 6 and the collar 7.

A multiplicity of tubes 10 is advantageously planned around the central tube 9. The arrangement of these tubes 10 is generally regular and annular, the tubes 10 can be arranged according to at least a crown the center of which is located on the axis AA of the body forming the venturi.

Preferably, tubes 10 and the central tube 9 are identical with one another, presenting a overall circular cross section and are arranged in an annular fashion, according to at least a crown, the center of which is located on the axis AA of the venturi, The number of tubes 10 is calculated according to the air flow necessary for the combustion and the internal diameter of the venturi body.

Advantageously, all the feed tubes 13 are connected to the same source of motive fluid under pressure.

Preferably, at least the tubes 10 arranged in an essentially annular fashion around the axis AA of the venturi 5 and situated the furthest to the outside of this axis inject the motive fluid in the venturi along an angle α, formed with the axis AA of the venturi 5, greater than 3°, and preferably essentially equal to the one that form the divergent flare 8 with said axis, their bottom part 12 can be cylindrical and essentially parallel to the AA axis of the venturi 5, while, as is visible on FIG. 2, the inclination angle of their upper part 11 with respect to axis AA is essentially equal to the inclination angle of the divergent 8 with regard to this same axis AA.

In a variant of the invention not represented in the figures, the axes of the tubes 10 can form with the axis AA of the venturi 5 an angle essentially equal to the one that the divergent flare forms with the axis of the said venturi.

The tubes 10 generally all penetrate into the venturi to the same depth which can be identical or less than the penetration depth of the central tube 9 in the venturi 5.

According to a variant (not represented in the figures) the central tube 9 is replaced by a second multiplicity of tubes arranged in an annular fashion around the axis AA, in such a manner that they are surrounded by tubes 10.

As indicated above, in a same device, the tubes 10 as well as the central tube 9 (or the multiplicity of tubes that replaces it) can be identical to one another, they have an overall circular cross section and are all preferably joined to the feed tube 13, which is itself connected to a source of motive fluid. They are dimensioned so that they carry between 1% and 33% of the motive fluid and, preferably, between 5% and 33% of said fluid.

Advantageously, devices 3, arranged in annular fashion around the end of the input tube 2 of gas to be burned, can all be identical.

Figure 3:
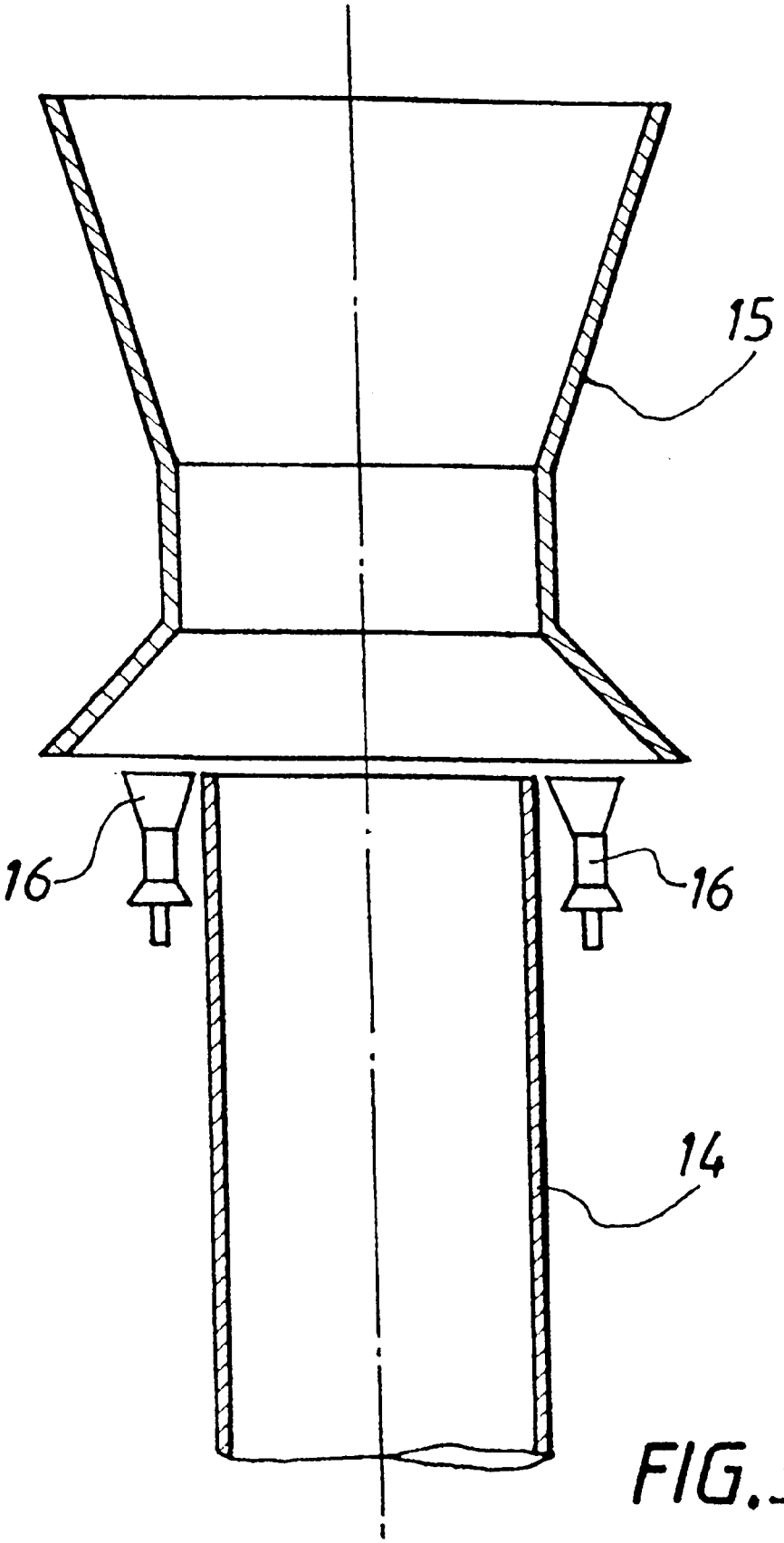
FIG. 3 illustrates a particular use of the invention to burn acidic gases such as hydrogen sulfide.

A variant of the invention can also be used, as indicated in this FIG. 3, for the burning of gases requiring a high combustion temperature, hydrogen sulfide for example, where the oxidation temperature is greater than 700° C.

As can be seen from FIG. 3, the combustion zone 1 is covered by a body forming venturi 15, into which gas to be burned is injected by means of the tube 2, said body allows a higher temperature and residence time to be maintained while keeping the flame from external perturbations. According to the invention, a multiplicity of devices is arranged in an annular fashion around the end to the input tube 2 of the gas to be burned, so that the motive fluid coming out of each of the divergent flares of the multiplicity of devices is injected into the body forming venturi 15, thus improving the combustion of gas to be burned.

Process According to the Invention

According to the invention, in order to improve the combustion of gases by supplementary contribution of comburant, it is fed by means of a motive fluid intake 4 from of each of the devices 3.

As a motive fluid air is generally used, air enriched with the oxygen, a gas which is itself combustible or steam. The motive fluid pressure is usually comprised between 0.5 and $6.10^5$ Pa (0.5 to 6 bars) and, preferably, between 1 and $3.10^5$ Pa (1 to 3 bars).

No combustion is therefore produced inside devices 3, because these latter merely have the role to improve the combustion of combustible gases, by provoking an increase of the induction of the comburant (air) and a turbulence encouraging the mixing between the carburant and the comburant.

At the time of the operation of the equipment according to the invention (see FIG. 1), the combustion gas is introduced coaxially into the combustion zone 1 according to the arrows G. The combustion is produced in the combustion zone 1. It is promoted by devices 3, which, due to the introduction of a motive fluid, alone or in a mixture, according to the arrows H, entrain air through the venturi 5, following the arrows I. This entrained air emerges through the divergent flare of the device concerned and then improves the combustion of gases.

Hence, the use of devices 3 thus permits a complete combustion of a gas containing a hydrocarbon, a mixture of hydrocarbons, an acidic gas or a mixture of these gases, due to a high entrainment of air with a low quantity of motive fluid. This translates into a noise reduction, with respect to existing flares, where an air induction is realized with the help of classic tubes fed by steam at the level of the combustion zone. In effect, as the noise is due to the expansion of the motive fluid in the tubes, the use of a lesser quantity of fluid causes a noise reduction.

The Applicant has noted, during testing he has performed, that the use of the equipment according to the invention requires a flow of the steam necessary to ensure a smokeless combustion, that is 14 times less than the flow required by the classic flares to obtain the same result.

The equipment according to the invention has in addition the advantage to be able to be easily realizable on a platform, in a short time, while simply servicing a classic flare, which only causes a short duration shutdown in the operations of the refining unit, or on an oil and gas production site. The loss of production is therefore minimal.

What is claimed is:

1. Gas flare-type equipment to facilitate the combustion of combustible gases in the atmosphere, containing a combustion zone (1) fed by at least one input tube (2) of combustion gas to be burned, an end of said tube being surrounded by a multiplicity of devices (3) arranged around said end and each device of said multiplicity of devices (3) composed of a venturi (5) and a fluid motive feed (4), wherein:

each device of said multiplicity of devices (3) includes a multiplicity of tubes (10) arranged in an essentially annular shape around an axis AA of the venturi (5); and said multiplicity of tubes (10), that injects the motive fluid in the venturi (5), diverge from one another by forming an angle with the axis AA of the venturi (5) greater than 3°.

2. Equipment according to claim 1, characterized in that the multiplicity of devices (3) are arranged essentially in symmetrical form around the end of the input tube (2) of the gas to be burned.

3. Equipment according to claim 2, characterized in that the multiplicity of devices (3) are arranged essentially in annular form around the end of the input tube (2) of the gas to be burned.

4. Equipment according to claim 1, characterized in that the axis AA of the venturi (5) of each device of the multiplicity of devices (3) forms with an axis BB of the input tube (2) of gas to be burned an angle β comprised between 1° and 70°.

5. Equipment according to claim 4, characterized in that the axis AA of the venturi (5) of each device of the multiplicity of devices (3) forms with an axis BB of the input tube (2) of gas to be burned an angle β comprised between 50° and 60°.

6. Equipment according to claim 1, characterized in that feed tubes (13) of the multiplicity of devices (3) are connected to the same source of motive fluid under pressure.

7. Equipment according to claim 1, characterized in that the multiplicity of devices (3) are arranged essentially in annular form around the end of the input tube (2) of the gas to be burned, and each tube of the multiplicity of tubes (10) of each device of the multiplicity of devices (3) is dimensioned so that it can carry between 1% and 33% of the motive fluid.

8. Equipment according to claim 7, characterized in that the multiplicity of devices (3) are arranged essentially in annular form around the end of the input tube (2) of the gas to be burned, and each tube of the multiplicity of tubes (10) of each device of the multiplicity of devices (3) is dimensioned so that it can carry between 5% and 33% of the motive fluid.

9. Equipment according to claim 1, characterized in that the fluid motive feed (4) of each device of the multiplicity of devices (3) includes a central tube (9) and a multiplicity of tubes (10) arranged in an annular fashion around the axis AA of the venturi (5).

10. Equipment according to claim 1, characterized in that the fluid motive feed (4) of each device of the multiplicity of devices (3) includes two multiplicities of tubes respectively arranged in annular fashion around the axis AA of the venturi (5).

11. Equipment according to claim 1, characterized in that the multiplicity of tubes (10) of a device of the multiplicity of devices (3) are all identical to one another and present an overall circular cross-section.

12. Equipment according to claim 1, characterized in that the multiplicity of tubes (10) are arranged in an annular fashion, according to at least a crown, the center of which is located on the axis AA of the venturi (5).

13. Equipment according to claim 1, characterized in that the combustion zone (1) is surrounded by a venturi (15) arranged downstream from the devices (3).

14. A process of facilitating the combustion in the atmosphere of a combustible gas, comprising a step of supplying an equipment according to claim 1 with a combustible gas via input gas tube (2) while tubes (13) of the multiplicity of devices (3) of the motive fluid input are supplied by a fluid chosen from the group consisting of air enriched with oxygen, steam and a combustion gas, characterized in that a motive fluid pressure is comprised between 0.5 and $6\times10^5$ Pa, and in that each tube of the multiplicity of tubes (10) transports between 1% and 33% of this motive fluid.

15. The process according to claim 14, characterized in that a motive fluid pressure is comprised between 1 and $3\times10^5$ Pa, and in that each tube of the multiplicity of tubes (10) transports between 1% and 33% of this motive fluid.

16. The process according to claim 14, characterized in that a motive fluid pressure is comprised between 0.5 and $6\times10^5$ Pa, and in that each tube of the multiplicity of tubes (10) transports between 5% and 33% of this motive fluid.

17. Equipment according to claim 1, wherein said multiplicity of tubes (10), that injects the motive fluid in the venturi (5), diverge from one another by forming an angle with the axis AA of the venturi (5) that is essentially equal to the angle that a divergent flare (8) of the venturi (5) forms with the axis AA.

* * * * *